US005670211A

United States Patent [19]

Huber et al.

[11] Patent Number: 5,670,211

[45] Date of Patent: Sep. 23, 1997

[54] METHOD FOR APPLYING LIQUID TO SHEET MATERIAL

[75] Inventors: Kenneth G. Huber, Grand Blanc; Richard P. Doerer, Gross Pointe; Normand R. Marceau, Fenton, all of Mich.

[73] Assignee: Hoover Universal, Inc., Plymouth, Mich.

[21] Appl. No.: 528,099

[22] Filed: Sep. 14, 1995

[51] Int. Cl.[6] ..... B05D 5/00

[52] U.S. Cl. ..... 427/244; 427/340; 427/341; 427/342; 427/377; 427/378; 427/421; 427/428

[58] Field of Search ..... 427/340–2, 244, 427/377, 378, 421, 428

[56] References Cited

U.S. PATENT DOCUMENTS

| | | | |
|---|---|---|---|
| 4,451,310 | 5/1984 | Lairloup | 156/78 |
| 4,713,265 | 12/1987 | Nahas et al. | 427/341 |
| 4,803,116 | 2/1989 | Amano et al. | 427/342 X |
| 5,154,950 | 10/1992 | Rosthauser et al. | 427/340 |
| 5,385,610 | 1/1995 | Deerer et al. | 118/241 |

*Primary Examiner*—Michael Lusignan

*Attorney, Agent, or Firm*—Harness, Dickey and Pierce, P.L.C.

[57] ABSTRACT

A method of applying a two-part liquid composition to a workpiece is provided. In particular, a two-step method is provided wherein a first liquid composition is applied to the workpiece by roll coating, and a second liquid composition is applied by spraying the workpiece. Generally, the first liquid composition is a polyurethane adhesive and the second liquid composition is a polyurethane catalyst. By applying the reactive components of the polyurethane composition in two steps, the open time may be controlled.

6 Claims, 2 Drawing Sheets

METHOD FOR APPLYING LIQUID TO SHEET MATERIAL

FIELD OF THE INVENTION

The present invention relates generally to a method of applying a liquid to sheet material and in particular, to a method of applying a polyurethane composition to sheet material workpieces.

BACKGROUND OF THE INVENTION

There are numerous instances in commercial material processing where liquids are coated onto sheet materials. For example, in the manufacture of headliners used in passenger motor vehicles, such processes are frequently employed. Various techniques and designs of headliner manufacturing are presently known. In one process, an armature of soft flexible polyurethane foam is cut into thin sheets and coated with reactive components in a liquid state which polymerize to form a polyurethane which stiffens the substrate. Multiple layers of sheet materials may be coated and pressed together to provide adequate stiffness.

Various techniques for coating headliner substrates and other multi-layer assemblies are known. In one process, one liquid or two reactive components in liquid form, are sprayed onto the sheet material workpiece as it passes along a conveyer through a processing station. Another process for coating substrates is known as roll coating. In this process, sheet material is fed between rolls which are coated with a liquid which transfers onto the workpiece. Although such machines generally operate satisfactorily, they have a significant shortcoming; namely, they must be manually adjusted for a particular workpiece material thickness.

The invention set forth in U.S. Pat. No. 5,385,610, incorporated by reference herein, overcomes many of the disadvantages of the roll coating machines described above. In particular, the roll coating machine described therein includes various mechanisms for providing an automatic adjustment characteristic. In one approach, one of the coating rollers is provided with an adjustment system including a moveable frame member which allows it to respond based on the pressure applied to it by the workpiece to adjust itself to an optimal roller separation. Despite the fact that the roll coater mechanisms are massive, the device enables the rollers to respond to extremely minute forces exerted by the workpiece between the rollers, attributable in part to a precision counter-balancing of a moveable frame member which supports one of the rollers.

Another adjustment approach set forth in U.S. Pat. No. 5,385,610 employs automatic pre-gauging in which a part is measured and a cam and follower device is actuated to set the separation between the coating rollers. In a hybrid arrangement, pre-gauging is used to set the coating roller separation within a range associated within a certain workpiece and the self-adjusting pressure actuated system described previously is employed to provide the final adjustment.

Irrespective of the approach used in accordance with U.S. Pat. No. 5,385,810, parts of various thicknesses can be fed serially through the machine and a proper coating operation will be provided. This capability is especially advantageous where a wide range of material thickness are found in a finished item, for example in a headliner assembly in which a relatively thick soft polyurethane foam sheet is coated and thereafter reinforcing fiberglass mats or scrims and trim materials are coated to build up the various layers that define the headliner.

Although the invention set forth in U.S. Pat. No. 5,385,610 overcomes many of the disadvantages in the art, it encompasses a roll coating process wherein the workpiece is coated by the rollers with a reactive component in a liquid state. The reactive component, generally a polyol and an isocyanate, when applied to the workpiece, immediately react to form a polyurethane. There is therefore little, if any, control of the "open time", or the time between when the liquid component is applied to the workpiece and when it reacts to form a polyurethane.

It would thus be desirable to provide a method of applying a liquid polyurethane composition to a workpiece wherein the open time can be controlled. It would also be desirable to provide a method of applying a liquid polyurethane composition to a workpiece wherein the cost and maintenance associated with such an application is relatively low.

SUMMARY OF THE INVENTION

A method of applying a two-component liquid composition to a workpiece is provided. In particular, a two-step method is provided wherein a first liquid composition is applied to the workpiece for example, a polyurethane foam, by roll coating, and a second liquid composition is applied by spraying the workpiece for example, in a misting chamber. Generally, the first liquid composition is a polyurethane adhesive and the second liquid composition is a polyurethane catalyst. By applying the reactive components of the polyurethane composition in two steps, the open time may be controlled.

Additional objects, advantages, and features of the present invention will become apparent from the following description and appended claims, taken in conjunction with the accompanying drawings.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

A method of applying a liquid polyurethane composition to a workpiece is provided. In particular, a two-step method is provided wherein a polyurethane adhesive is applied to the workpiece by roll coating, and a polyurethane catalyst is applied by spraying the workpiece for example, in a misting chamber. By applying the reactive components of the polyurethane composition in two steps, the open time may be controlled.

In the first step of the method of the present invention, a polyurethane adhesive is applied to the workpiece by roll coating. The roll coating apparatus and method set forth in U.S. Pat. No. 5,385,610 is preferred, which allows materials having different thicknesses to be coated.

As used herein, by polyurethane adhesive is meant an isocyanate prepolymer made, for example, by reacting MDI with polypropylene oxide diol. Any polyurethane adhesive known to those skilled in the art may be employed however, the polyurethane adhesive 2U010 manufactured by Swift Adhesives, Research Triangle Park, N.C., is preferred. The polyurethane adhesive should be applied at about 75% to about 95% by weight of the total polyurethane composition, and about 85% is preferred.

In the second step of the method of the present invention, a polyurethane catalyst is applied to the workpiece by spraying in a misting chamber. The polyurethane catalyst is misted onto the workpiece by passing the workpiece through a chamber having automatic air atomizing nozzles. In a preferred embodiment, the nozzles provide independent control of the liquid, atomizing air and fan air pressures which allows drop size and spray pattern to be controlled. In a highly preferred embodiment, the AutoJet® nozzle manufactured by Spraying Systems Company (Wheaton, Ill.), is employed. The Data Sheet (37459-V) and Bulletin (No. 35S) describing the AutoJet® nozzle are hereby incorporated by reference.

As used herein, by polyurethane catalyst is meant water that contains an amine, preferably a tertiary amine, as a catalyst. Although any polyurethane catalyst known to those skilled in the art may be employed, in a preferred method, the polyurethane catalyst 2U011-4N manufactured by Swift Adhesives, is employed. 2U011-4N comprises from about 70% to 100% water, from about 1% to 10% 1.4diazabicyclo (2,2,2)octane, from about 1% to 10% dimethylaminoethanol, about 1% to 10% acrylic latex and about 1% to 10% sodium dodecylbenzene sulfonate. The polyurethane catalyst should be applied at about 5% to about 25% by weight of the total polyurethane composition and about 15% is preferred.

It will be appreciated by those skilled in the art that by "workpiece" is meant any sheet material commonly employed, for example, flexible or semi rigid foam sheets and in particular, polyurethane foam sheets, styrene foam sheets, PPO foam sheets, expanded polystyrene foam sheets and expanded polypropylene foam sheets.

Figure 1:
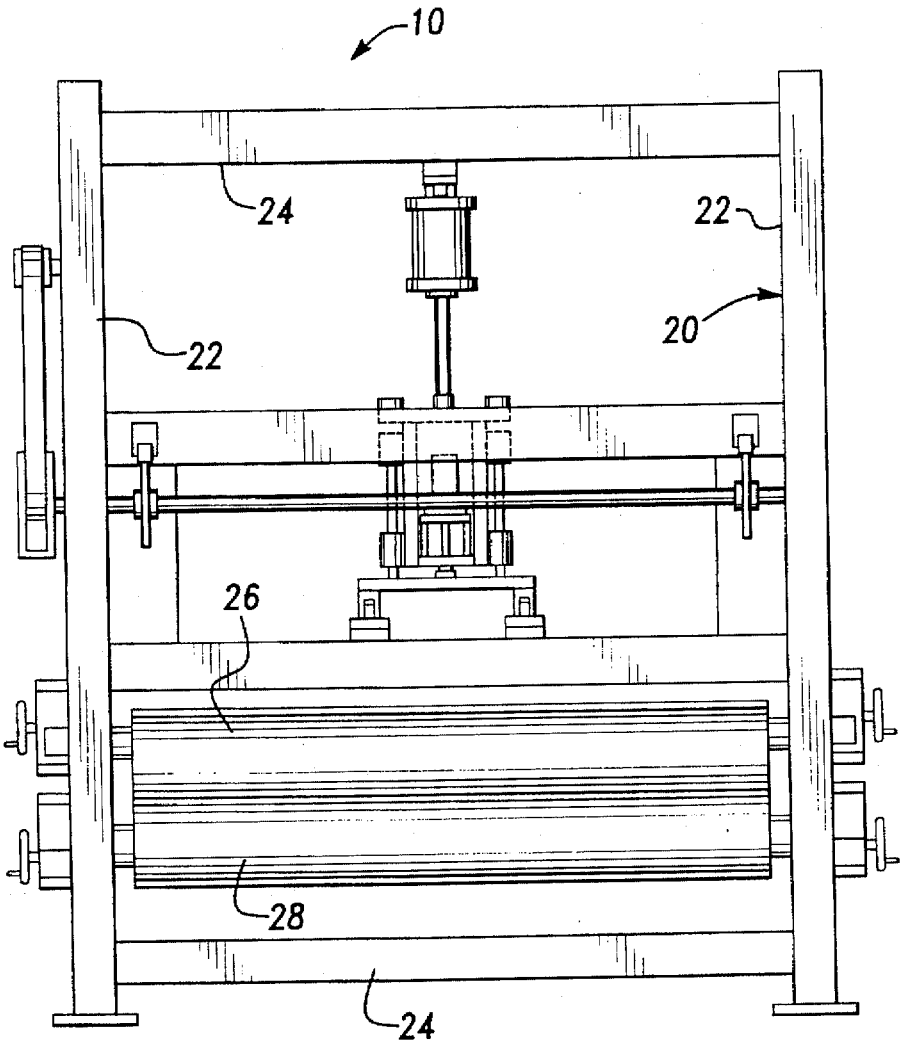
FIG. 1 is a front elevational view of the preferred roll coater machine employed in the method of the present invention.
Figure 2:
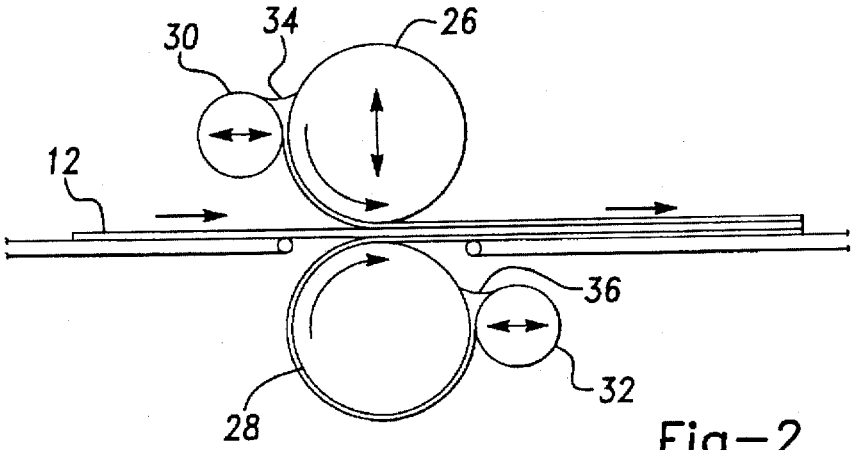
FIG. 2 is a simplified schematic view showing the preferred roll coating operation employed in the method of the present invention.

Turning now to FIG. 1, in a preferred embodiment, roll coater machine 10 has a large external frame 20 having vertical posts 22 and horizontal beams 24 which support the various elements comprising the machine. Machine 10 includes a pair of coating rollers 26 and 28, with upper roller 26 provided for coating the top surface of a workpiece, whereas lower coating roller 28 is provided for coating the bottom surface of the workpiece. Rollers 26 and 28 are accurately machined cylinders which may be chrome plated. As shown in FIG. 2, a pair of doctor rollers 30 and 32 are provided for coating rollers 26 and 28, respectively. Doctor rollers 30 and 32 are closely spaced against the associated coating rollers. A volume of a liquid material defining fluid baths 34 and 36 are retained between the associated rollers. End plates (not shown) are provided at the axial ends of the rollers to define the ends of the fluid baths. By maintaining a very close spacing between the coating rollers and associated doctor rollers the fluid baths 34 and 36 are retained.

As shown in FIG. 2, the coating rollers and doctor rollers rotate in opposite rotational directions. By accurately adjusting the separation between the coating rollers 26 and 28 and the associated doctor rollers 30 and 32, a fluid film of a desired thickness adheres to the coating roller which in turn contacts the workpiece 12 to apply a film on the workpiece 12. In some instances it may be desirable to apply more liquid to one of the surfaces of the workpieces which can be accommodated by appropriate roller separation adjustments. A mechanism for maintaining the level of fluid in fluid baths 34 and 36 is provided which could be of conventional construction.

Figure 3:
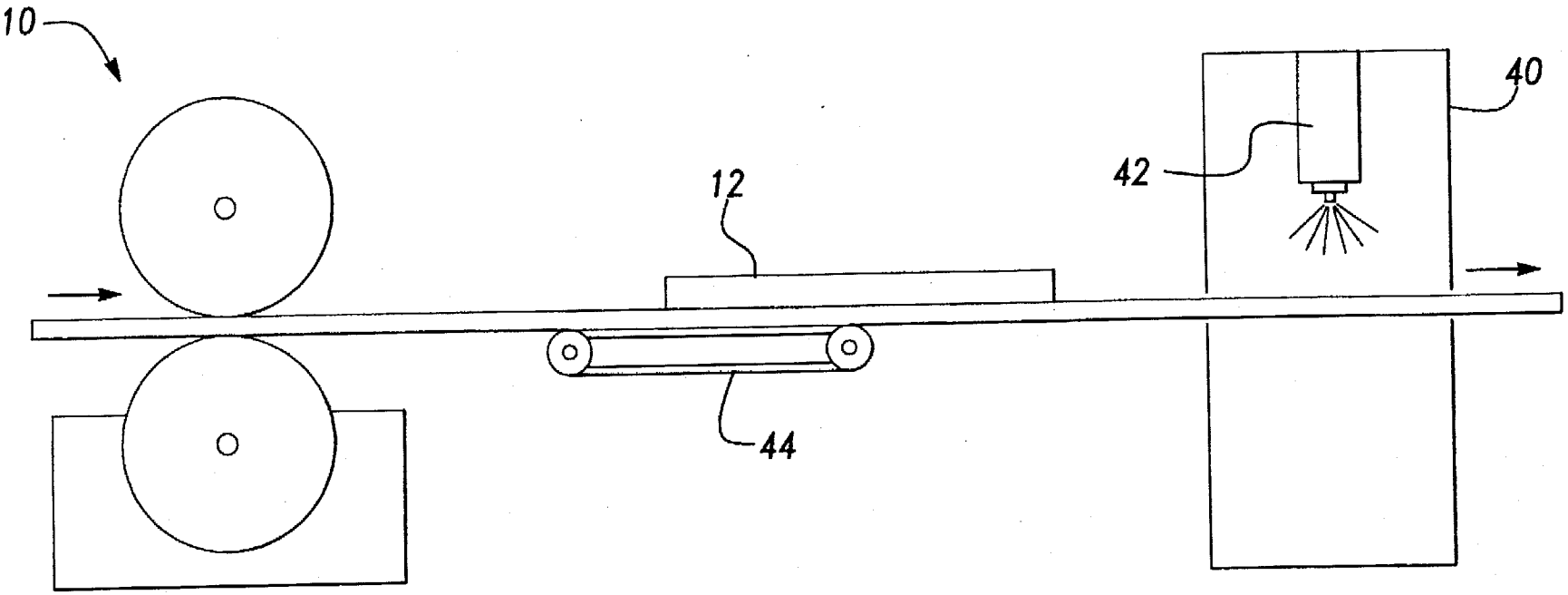
FIG. 3 is a simplified schematic view showing the roll coating and misting chamber employed in the method of the present invention.

As shown in FIG. 3, misting chamber 40 is shown in schematic form, includes a variable spray nozzle 42. The spray nozzle 42 coats the workpiece 12 by misting the liquid onto the workpiece 12. The misting chamber 40 is constructed so as to avoid aberrant spray.

In the method of the present invention, as shown in FIG. 3, a conveyer 44 moves the workpiece 12 through the roll coater machine 10 where the workpiece 12 is roll coated with a polyurethane adhesive. The conveyer 44 then moves the workpiece 12 through the misting chamber 40 where the workpiece 12 is sprayed with a polyurethane catalyst. The conveyer then moves the workpiece 12 to the next manufacturing station.

It will be appreciated from reading the above description of the present invention that the "open time" or the time between when the liquid component is applied to the workpiece and when it reacts to form a polyurethane may be controlled in the method described herein. In particular, the workpiece may be roll coated with the polyurethane adhesive and at a preselected time, the workpiece may be sprayed with the polyurethane catalyst, thereby initiating the reaction to form a polyurethane coating on the workpiece.

In addition, it will be appreciated that the workpiece described herein, once roll coated and sprayed, may be cured (and the cure accelerated at a greater temperature), and used in applications known in the art. For example, the workpiece may be formed into an automotive headliner, rear shelf, seat back, quarter trim panel, trunk liner and hood liner.

It will also be appreciated that although the invention is described with respect to a two-step method, the present invention also includes multiple steps, for example, repeating the roll coating process more than once prior to the spraying steps.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

We claim:

1. A method of applying a two-component liquid composition to sheet material comprising the steps of:

a) applying the first component of the liquid composition to the sheet material by roll coating the first liquid component onto the sheet material, wherein the first component is a polyurethane adhesive comprising from about 75% to about 95% by weight of the liquid composition; and b) applying the second component of the liquid composition to the sheet material by spraying the second liquid component onto the sheet material, wherein the second component is a polyurethane catalyst comprising from about 5% to about 25% by weight of the liquid composition.

2. The method of claim 1, wherein the sheet material is a polyurethane foam.

3. The method of claim 1, wherein the spraying of the second liquid component onto the sheet material is in a misting chamber.

4. A method of producing a polyurethane-coated sheet material comprising the steps of:

a) applying a liquid polyurethane adhesive to the sheet material by roll coating the polyurethane adhesive onto the sheet material, wherein the polyurethane adhesive comprises from about 75% to about 95% by weight of the liquid composition; and b) applying a liquid polyurethane catalyst to the sheet material by spraying the polyurethane catalyst onto the sheet material, wherein the polyurethane catalyst comprises from about 5% to about 25% by weight of the liquid composition.

5. The method of claim 4, wherein the sheet material is a polyurethane foam.

6. The method of claim 4, wherein the spraying of the second component onto the sheet material is in a misting chamber.

* * * * *